United States Patent [19]

McKay

[11] Patent Number: 4,706,728

[45] Date of Patent: Nov. 17, 1987

[54] APPARATUS FOR MOUNTING SCREENS

[76] Inventor: Donald McKay, c/o Low-Drape, 25 Colvilles Place, Kelvin Industrial Estate, East Kilbride, Glasgow, Scotland, G75 0PZ

[21] Appl. No.: 835,539

[22] Filed: Mar. 3, 1986

[51] Int. Cl.[4] ..... A47H 1/00

[52] U.S. Cl. ..... 160/339; 160/178 R

[58] Field of Search ..... 160/338, 339, 178 R, 160/178 C; 24/115 R; 248/261

[56] References Cited

U.S. PATENT DOCUMENTS

| | | | |
|---|---|---|---|
| 2,565,280 | 8/1951 | Tapp | 160/339 X |
| 2,643,846 | 6/1953 | Lundstrom | 160/339 X |
| 4,469,198 | 9/1984 | Crump | 182/142 X |

FOREIGN PATENT DOCUMENTS

| | | | |
|---|---|---|---|
| 487357 | 10/1952 | Canada | 160/339 |
| 449778 | 3/1913 | France | 160/339 |
| 1575734 | 7/1969 | France | 160/338 |
| 1158731 | 7/1969 | United Kingdom | 160/339 |

*Primary Examiner*—J. Franklin Foss

*Attorney, Agent, or Firm*—Ratner & Prestia

[57] ABSTRACT

Apparatus for mounting screens, such as curtains, comprises a support member suspended from a mounting member. The support member is movable from an in-use position, where a screen hanging from the support member is positioned in its normal in-use location, to a maintenance position in which the support member, and the means for attaching the screen to the support member, are easily accessible.

2 Claims, 18 Drawing Figures

APPARATUS FOR MOUNTING SCREENS

This invention relates to apparatus for mounting screens especially but not exclusively to apparatus for mounting curtains.

Curtain rails are normally secured to the wall above the window the curtains are intended to cover. This makes the fitting and removal of curtains very awkward as it is necessary to stand on a chair or use a stepladder to gain access to the rail. For elderly persons, in particular, this can be a dangerous, if not impossible, task.

It is an object of this invention to obviate or mitigate this disadvantage.

According to the present invention there is provided apparatus for mounting screens, comprising a support member suspended from a mounting member, the support member being movable between an in-use position adjacent the mounting member and a maintenance position in which the support member is easily accessible.

Preferably, the mounting member is fixed to a support surface, such as a wall, above a window.

Preferably also, the support member is a screen support such as a curtain rail.

Preferably also, the support member is connected to a first end portion of a suspension member. The suspension member may be a length of nylon line.

Preferably also, a retaining member, which may be secured to a support surface is provided on a second end portion of the suspension member.

Preferably also, the suspension member is supported, intermediate its ends, by the mounting member.

Preferably also, stabilisers are provided at end portions of the support members. The stabilisers may prevent the support member from twisting while it is being moved from the in-use position to the maintenance position.

An embodiment of the invention will now be described, by way of example, with reference to the accompaying drawings, in which.

Figure 1:
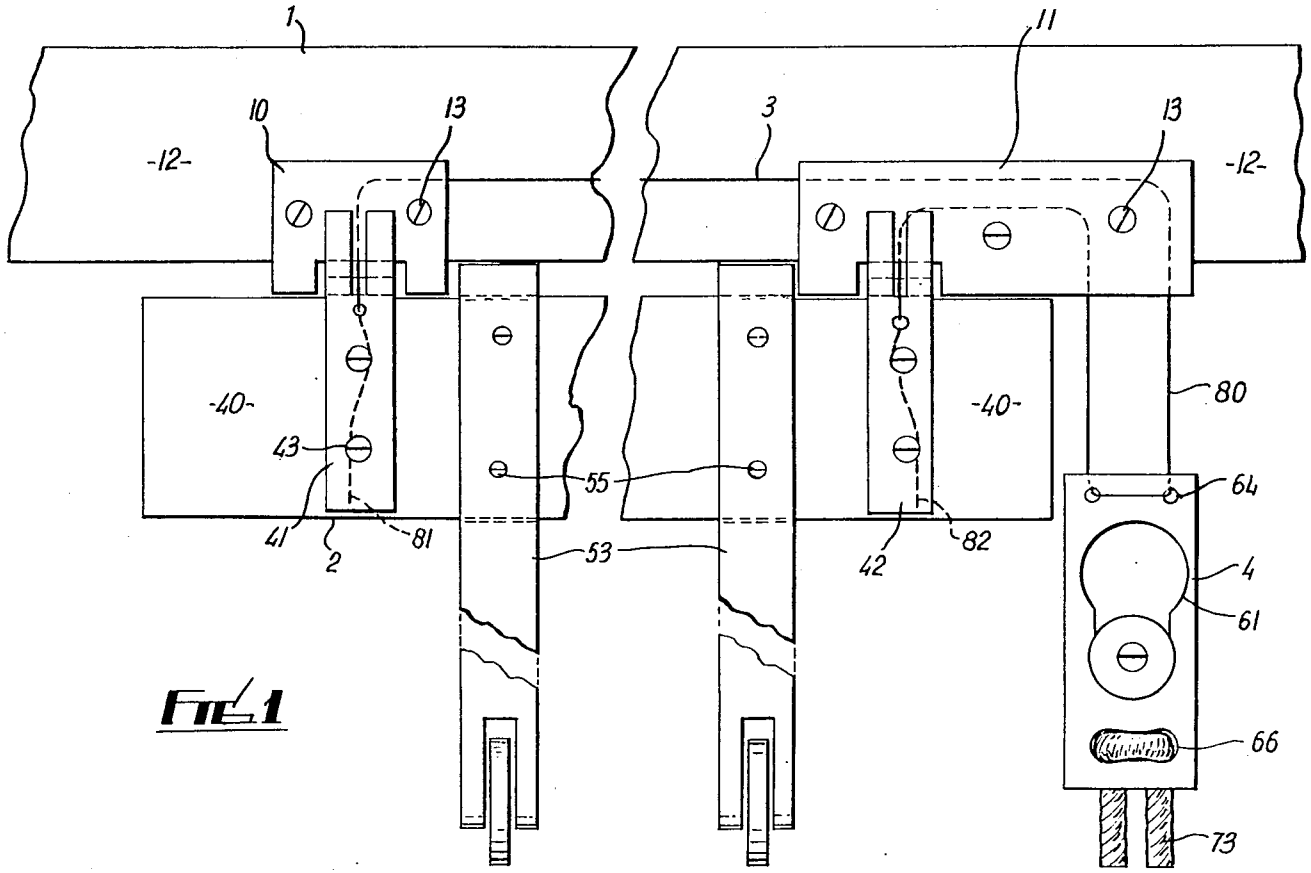
FIG. 1 is a part cut-away view of the apparatus for mounting screens made in accordance with the present invention.
Figure 2:
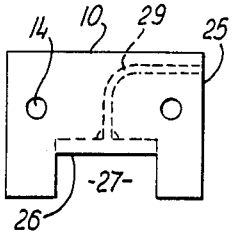
FIG. 2 is a front view of the left hand nylon line guide of the apparatus of FIG. 1.
Figure 3:
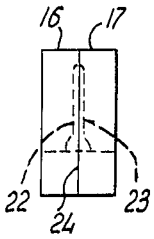
FIG. 3 is a side view of the line guide of FIG. 2.
Figure 4:
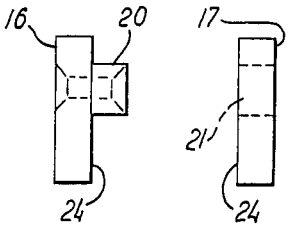
FIG. 4 is an exploded side view of the line guide of FIG. 2.
Figure 5:
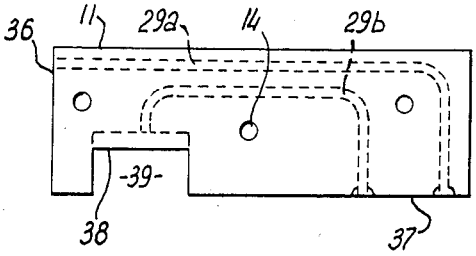
FIG. 5 is a front view of the right hand nylon line guide of the apparatus of FIG. 1.
Figure 6:
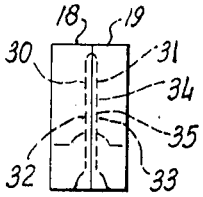
FIG. 6 is a side view of the line guide of FIG. 5.
Figure 7:
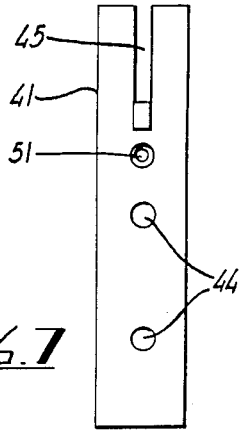
FIG. 7 is a front view of one of the nylon line fixing brackets of the apparatus of FIG. 1.
Figure 8:
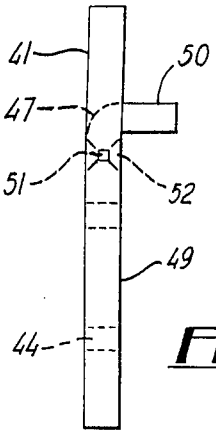
FIG. 8 is a side view of the line fixing bracket of FIG. 7.
Figure 9:
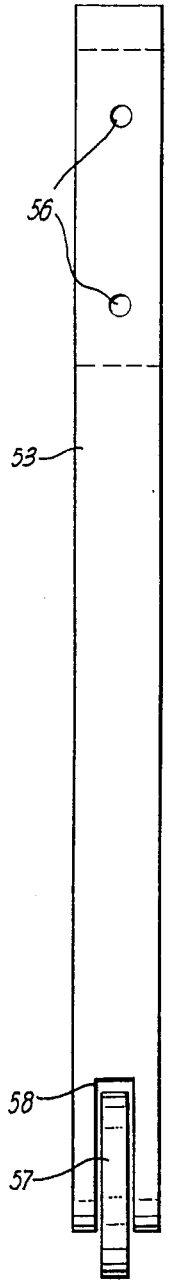
FIG. 9 is a front view of one of the stabilisers of the apparatus of FIG. 1.
Figure 10:
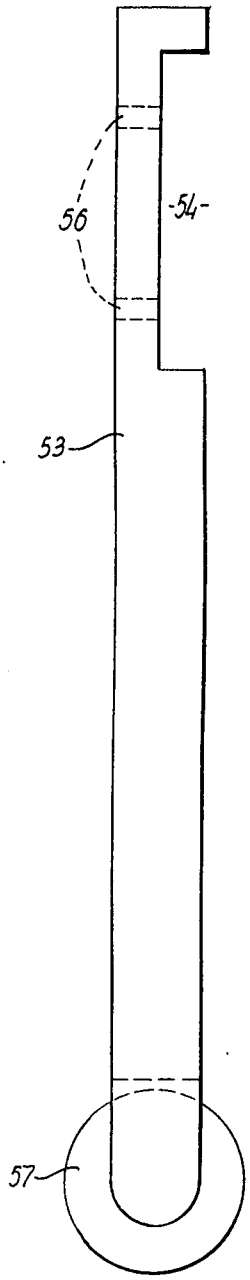
FIG. 10 is a side view of the stabiliser of FIG. 9.
Figure 11:
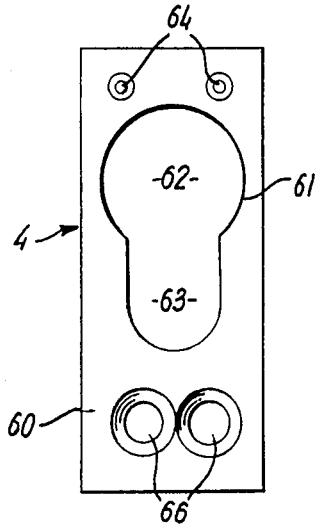
FIG. 11 is a front view of the retaining member of the apparatus of FIG. 1.
Figure 12:
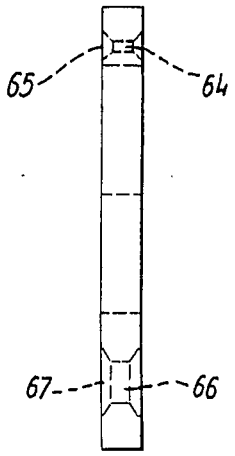
FIG. 12 is a side view of the retaining member of FIG. 11.
Figure 13:
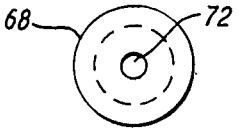
FIG. 13 is a front view of the retaining hook of the apparatus of FIG. 1.
Figure 14:
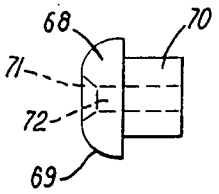
FIG. 14 is a side view of the retaining stopper of FIG. 13.

Referring to the accompanying drawings, apparatus for mounting screens, and in this example curtains, comprises a mounting member 1, a support member 2, a suspension member 3 and a retaining member 4.

The mounting member 1 has two nylon line guides 10, 11 secured to a timber strap 12 by screws 13 which pass through countersunk holes 14 in the line guides 10, 11 to a wall (not shown). The line guides 10, 11 each have front parts 16, 18 and rear parts 17, 19. The front parts 16, 18 of the line guides 10, 11 are provided with bushes 20 which fit into holes 21 in the rear parts 17, 19 of the line guides 10, 11.

The front 16 and rear 17 parts of the left hand line guide 10 are provided with grooves 22, 23 on their inside mating surfaces 24. The grooves 22, 23 run from the right hand edges 25 of the line guide 10 to the top face 26 of a rectangular notch 27 provided in the lower part of the line guide 10. When the two parts 16, 17 of the line guide 10 are fitted together the grooves 22, 23 form a conduit 29.

The front 18 and rear 19 parts of the right hand line guide 11 are provided with a first pair of grooves 30, 31 and a second pair of grooves 32, 33 on their inside mating surfaces 34, 35. The first pair of grooves 30, 31 run from the left hand face 36 of the line guide 11 to the bottom face 37 of the guide. The second pair of grooves 32, 33 run from the top face 38 of a rectangular notch 39 provided in the lower left hand part of the line guide 11 to the bottom face 37 of the guide 11. When the parts 18, 19 of the line guide 11 are fitted together the grooves 30, 31 and 32, 33 form two conduits 29*a*, 29*b*.

The support member 2 is in the form of a rectangular section beam 40.

Two line fixing brackets 41, 42 are secured to each end of the beam 40 by screws 43 which pass through holes 44 in the brackets 41, 42. Notches 45 are provided in the top part of the brackets. The bottom faces 47 of the notches 45 are curved in the form of a radius. On the rear face 49 of each bracket 41, 42 there is a laterally extending portion 50 having a rectangular cross section. Below each laterally extending portion 50 is a hole 51 which is countersunk 52 at both ends.

Two stabilisers 53 are secured to the beam 40 adjacent the fixing brackets 41, 42. A notch 54 is provided at the top portion of each stabiliser 53. The stabilisers 53 are secured to the beam by screws 55 which pass through holes 56 in the stabilisers 53.

A wheel 57 mounted on an axis (not shown) is provided in a slot 58 at the bottom end of each stabiliser 53.

The retaining member 4 is in the form of a plate 60 having a keyhole shaped opening 61. The opening 61 has a larger 62 and a smaller 63 diameter portion. Two holes 64, countersunk 65 at both ends are provided above the keyhole shaped opening 61. Two larger holes 66, also countersunk 67 at both ends, are provided below the opening 61. A cord 73 passes through the larger holes 66.

A retaining hook 68 has a rounded front portion 69 and a smaller diameter rear portion 70. A countersunk 71 hole 72 is provided thourgh the hook 68 to allow a screw (not shown) to be used to fix the hook 72 to a wall.

The suspension member 3 is a nylon line 80 and is attached at its ends 81, 82 to the fixing brackets 41, 42 on the support member 2.

The line 80 passes through the conduits **29, 29*a*, 29*b* in the line guides 10, 11 to the retaining member 4, where the line 80 passes through the smaller holes 64**.

Figure 16:
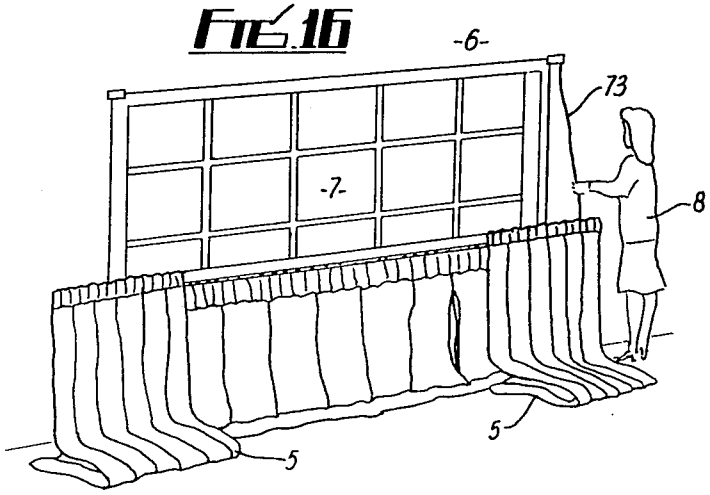
FIG. 16 is a perspective view of the curtains of FIG. 15 in the maintenance position.
Figure 18:
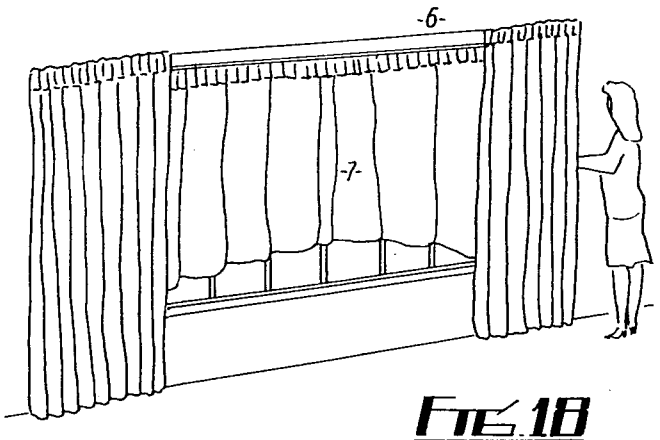
FIG. 18 is a perspective view of the curtains of FIG. 15 in the in-use position.
Figure 15:
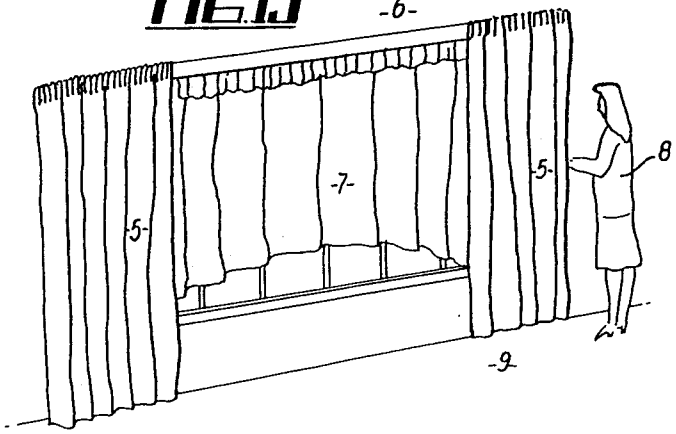
FIG. 15 is a perspective view of an operator preparing to lower curtains using the apparatus of FIG. 1.
Figure 17:
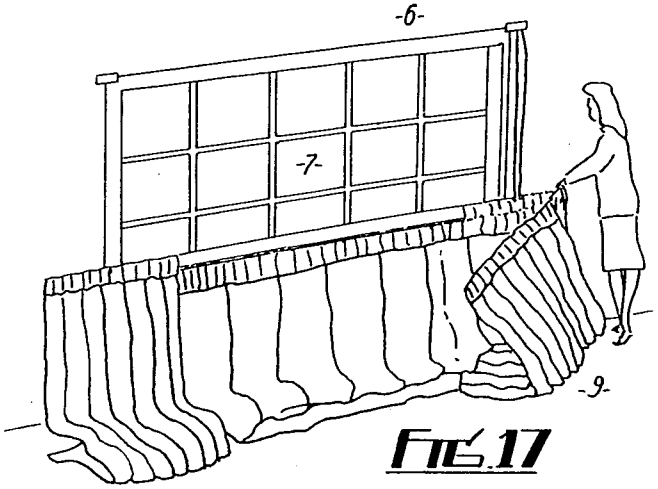
FIG. 17 is a perspective view of maintenance being carried out of the curtains of FIG. 15.

FIGS. 15, 16, 17 and 18 show the apparatus, in use. The line guides 10, 11, the line fixing brackets 41, 42 and the stabilisers 53 are hidden by the curtains 5 when they are in the normal position. The retaining hook 68 is secured to the wall 6 beside the window 7 at a convenient height. The retaining member 4 fits onto the hook 68 and the curtain 5 is held in position.

When the curtains 5 are to be changed the operator releases the retaining member 4 from the retaining hook 68 and lowers the curtains 5.

The wheels 57 on the stabilisers 53 travel down the wall 6, the stabilisers 53 preventing the support member 2 from twisting.

When the curtains 5 have been lowered to a convenient level they can be easily changed by a person 8 standing on the floor 9.

The curtains 5 can be raised by pulling on the cord 73 attached to the retaining member 7.

Modifications and improvements may be incorporated without departing from the scope of the invention.

What is claimed is:

1. Apparatus for mounting screens comprising:

a mounting member for attaching to a support surface; a support member having means for supporting a curtain rail;

a suspension member extending from said mounting member and engaging said support member, said suspension member providing means for producing vertical movement of said support member;

and stabiliser means, extending from said support member, having means for engaging said support surface to prevent twisting of the support member wherein said stabilizer means are in the form of struts extending from the support member, said struts having wheel means for engaging the support surface.

2. Apparatus for mounting screens as claimed in claim 1, wherein the suspension member is a length of cord fixed at each end to the support member, engaging guide means on the mounting member intermediate said ends, and being provided with retaining means remote from said ends for fixing to a support surface.

* * * * *